US005842579A

United States Patent [19]

Garcia et al.

[11] Patent Number: 5,842,579

[45] Date of Patent: Dec. 1, 1998

[54] ELECTRICAL CIRCUIT COMPONENT HANDLER

[75] Inventors: Douglas J. Garcia, Valley Center; Steven D. Swendrowski, San Diego; Mitsuaki Tani, Escondido; Hsang Wang; Martin J. Twite, III, both of San Diego; Malcolm V. Hawkes, Escondido; Evart David Shealey, Jamul; Martin S. Voshell, Lakeside; Jeffrey L. Fish, San Diego; Vernon P. Cooke, Escondido, all of Calif.

[73] Assignee: Electro Scientific Industries, Inc., Portland, Oreg.

[21] Appl. No.: 559,546

[22] Filed: Nov. 16, 1995

[51] Int. Cl.[6] ..... B07C 5/344

[52] U.S. Cl. ..... 209/573; 209/936; 198/393

[58] Field of Search ..... 209/573, 572, 209/571, 910, 920, 924, 936; 198/393, 464.2, 464.4

[56] References Cited

U.S. PATENT DOCUMENTS

| | | | |
|---|---|---|---|
| 5,034,749 | 7/1991 | Jungblut et al. | 209/573 |
| 5,492,215 | 2/1996 | Affeldt et al. | 198/464.4 |
| 5,568,870 | 10/1996 | Utech | 209/573 |

FOREIGN PATENT DOCUMENTS

| | | | |
|---|---|---|---|
| 3918777 | 12/1989 | Germany | 198/393 |

*Primary Examiner*—Donald W. Underwood
*Attorney, Agent, or Firm*—Thomas J. Tighe

[57] ABSTRACT

One or more concentric rings of component seats are rotatable about the rings' center. The seats are uniformly angularly spaced and the rings are incrementally rotated, the increment of rotation being the angular space between adjacent seats. The rings are inclined at an angle and a stream of components is poured onto the rings as they are rotating. Stationary fences adjacent to outboard sides of the seats, confine unseated components to tumble randomly, due to gravity, over empty seats passing through arcs of the rings' rotation paths. The random tumbling results in seated components. In the paths of the rotating rings are electrical contactors for coupling the components to a tester. Preferably there are five contactor stations to permit five different kinds of tests to be performed simultaneously. Tested components pass beneath an ejection manifold which defines a plurality of ejection holes which register with a set of seats each time the ring is rotated an increment. Ejection tubes are coupled to the ejection holes. The components are ejected from their seats by blasts of air from selectively actuated, respective pneumatic valves. Due to the blast of air and gravity, the ejected components travel down the tubes and are directed into sorting bins according to a tube routing plate. The stream of components can be selectively directed to each fence in response to a signal from a detector indicating that the fence is deprived of components. Sensors detect seated components that were not ejected by the ejection manifold.

21 Claims, 11 Drawing Sheets

ELECTRICAL CIRCUIT COMPONENT HANDLER

BACKGROUND OF THE INVENTION

This invention relates in general to electronic component handlers that receive electrical circuit components, for example ceramic capacitors, present them to an electronic tester for testing, and subsequently sort the components according to test results. As used herein the term "component" refers to ceramic capacitors and any other electrical device having a form that allows it to be handled by this invention.

The handler according to this invention is a significant advance over the prior art. It eliminates manual seating of components for test purposes and manual sorting afterwards. It handles a greater quantity of components per unit time than prior art handlers. It takes a randomly oriented heap of components and properly orients them, presents them to a tester in multiples, and provides a means for sorting the tested parts individually into any of a plurality of receiving bins, i.e. sorting bins.

Other advantages and attributes of this invention will be readily discernable upon a reading of the text hereinafter.

SUMMARY OF THE INVENTION

An object of this invention is to provide a component handler that has a significantly increased throughput over prior art handlers.

A further object of this invention is to provide a component handler that can receive a stream of randomly oriented components and automatically: (1) seat each component in a respective test seat properly oriented for testing, (2) electrically couple the seated components, in multiples, to a tester, and (3) subsequently unseat and sort tested components into selected ones of a plurality of receiving bins based on test results.

A further object of this invention is to provide a component handler as described above which can create the stream of components from a heap of components.

A further object of this invention is to provide a component handler as described above which includes a hopper and shaker mechanism for receiving heaps of components and creating a stream of same via a pour spout.

A further object of this invention is to provide a component handler as described above which includes a loading mechanism which receives the stream of components and seats them in a plurality of rings of seats defined by a rotating plate, the rings being concentric with the axis of plate rotation.

A further object of this invention is to provide a component handler as described above which can couple each seated component to a plurality of separate test circuits.

A further object of this invention is to provide a component handler as described above which can present each seated component to a plurality of test stations.

These objects, and other objects expressed or implied in this document, are accomplished by a component handler having one or more concentric rings of component seats; means for rotating the rings; means, in the paths of the rotating rings, for receiving a stream of components and seating them in the rings; means, in the paths of the rotating rings, for electrically contacting each seated component sufficiently for testing same; a plurality of receiving bins; and means, in the paths of the rotating rings, for ejecting each tested component from its seat and directing it into a selected receiving bin. Preferably the rings are defined by a disk-like test plate with the seats being through-holes that conform to a profile of the components along their terminal axis, but are slightly oversized to allow the components to be freely seated therein. Beneath the test plate is a vacuum plate also in the form of a disk-like ring. The vacuum plate defines vacuum channels which are concentrically adjacent to the rings. The vacuum channels are connected to a partial vacuum source and communicate this partial vacuum to the seats of each ring via linking channels defined by the bottom of the test plate. The handler further includes means for detecting components that were not ejected. In the preferred embodiment, the rings are inclined at an angle and the stream of components is poured onto the rings as they are rotating. Stationary fences confine the unseated components to tumble randomly, due to gravity, over empty seats passing through arcs of the rings' rotation paths, the random tumbling over the passing seats resulting in the seating of the components. The fences are concentric with the rings, each fence being disposed along and adjacent to an outboard side of the seats of its corresponding ring. In the preferred embodiment, the fences extend from substantially the nine o'clock position, relative to the rings to substantially the five o'clock position. The handler also includes means for selectively directing the stream of components to each fence, and further includes means for detecting the absence of components along a fence and communicating that condition to a handler processor which then directs the stream to the fence deprived of components. The seats of the rings are uniformly angularly spaced and the ring is preferably incrementally rotated, the increment of rotation being the angular space between adjacent seats. There are a plurality of upperside and underside contacts for coupling the components to a tester. The preferred upperside contacts are cantilevered leaves with elongated tips for keeping the components from popping out of their seats due to pressure applied by the leaves. The underside contacts are pin-type contacts. All the contacts are readily replaceable. Tested components pass beneath an ejection manifold which defines a plurality of ejection holes which register with a set of seats each time the ring is rotated an increment. Ejection tubes are coupled to the ejection holes. The components are ejected from their seats by blasts of air from selectively actuated, respective pneumatic valves. Due to the blast of air and gravity, the ejected components travel down to the tubes and are directed into sorting bins according to a tube routing plate.

DESCRIPTION OF THE PREFERRED EMBODIMENT

Figure 6:
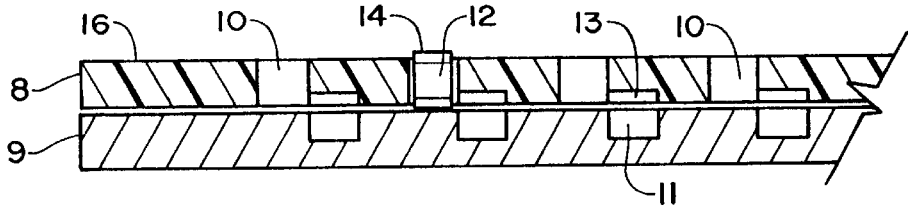
FIG. 6 is a partial cross-sectional view of a test plate taken along a radial line extending medially through a row of component seats defined by the test plate.

Referring to FIGS. 1–6 and 15, the invention, generally designated 2 is illustrated to have a supporting structure 4 having planar surface 6 inclined at preferably 60°. Extending through a hole defined by the inclined surface, is a turntable 7, also inclined at preferably 60°, for rotating a disk-like test plate 8. The test plate is in the form of a flat ring and defines a plurality of rows 5 of open component seats 10. The seats are designed to match the components that they are expected to seat. As best illustrated in FIG. 6, each seat is a through-hole and is sized to freely seat and hold a component 12 only when the component's "terminal axis" is aligned with the seat, within a tolerance. The terminal axis is an axis of the component running through its opposing terminals 14, and when so seated, one of the terminals protrudes above the face 16 of the test plate for being contacted from above, and the other terminal is exposed at the base of the seat for being contacted from below. Preferably the seats have a profile similar to that of their intended components, as viewed along the terminal axis, but are slightly larger than the components so that they can accept components entering at angles within a range of entry angles. The range of entry angles depends on how much lateral space can be tolerated between the components and the seat walls. As illustrated, each test plate row is a line of four radially spaced component seats, and the rows are uniformly angularly spaced around the test plate, forming four concentric rings of seats.

Referring again to FIGS. 5, 6, 8 and 16, beneath the component seat rings is a stationary "vacuum" plate 9 which supports the seated components. The vacuum plate is preferably, but not necessarily, a steel ring having a flat upper face that is chrome-plated to minimize friction between the stationary upper face and the moving components, and to minimize wear on the vacuum plate. The upper face of the vacuum plate defines a plurality of annular vacuum channels 11. There is a vacuum channel adjacent and concentric with each component seat ring. As illustrated for this embodiment, there are four vacuum channels, one inboardly adjacent to each seat ring. The vacuum channels are all coupled to a low pressure source (low relative to ambient pressure) so that during operation the vacuum channels communicate a partial vacuum to a plurality of linking channels 13 defined in the bottom of the test plate. These linking channels communicate the partial vacuum from the vacuum channels to the component seats. There is a linking channel communicating, one for one, with each component seat. By this arrangement components are urged into the seats and held there by the partial vacuum in the vacuum channels communicated to the seats via their respective linking channels.

Although this embodiment shows a certain number of test plate rows and a certain number of component seats per row, it should be understood that the number of rows and the number of seats per row can be different than illustrated without departing from the scope and purpose of this invention.

Referring again to FIGS. 1, 3, 4 and 15, the test plate 8 partially rests upon the turntable 7 and is properly located thereon by a plurality of locator pins 15 that mate with locator holes 17 defined near the inner rim of the test plate. As illustrated the test plate is rotated clockwise around a turntable hub 18. As the test plate turns, the component seats pass beneath a loading area generally designated 19, a contactor assembly 20, and an ejection manifold 22. As will be explained below, the components are deposited in test plate seats at the loading area and are thereafter rotated beneath the contactor assembly where each component is electrically contacted and parametrically tested.

Referring to FIGS. 3 and 7–9, to allow the test plate to be rotated at an optimum angular speed but yet ensure that each seated component gets thoroughly tested, the contactor assembly includes multiple spaced contactor modules 24, preferably five, each of which has an upperside contact 25 in line with each ring of component seats. Since in this embodiment there are four seat rings and the contactor assembly 20 can accommodate five contactor modules 24, there are five upperside contacts per ring of seats. On the opposite side of the test plate and in registration with the upperside contacts, one each, are twenty underside contacts 23. So if a handler according to this embodiment has a full complement of contactor modules (which need not be the case), the terminals of twenty seated components can be contacted simultaneously, thereby simultaneously coupling all twenty individually to a tester. A very significant improvement over the prior art.

The five contactor modules, and their corresponding underside contacts, can be used as five separate testing stations. This is particularly advantageous for testing ceramic capacitors which are often conventionally subjected to five stages of testing. During a typical first stage the capacitance and dissipation factor of the components are tested. A typical second stage test, commonly called a "flash" test, involves applying a high voltage (typically 2–2½ times the component's voltage rating) for a short time (typically 40–50 ms). During a typical third stage test a low voltage (e.g. 50 v) is applied for testing the leakage current or insulation resistance. During a typical fourth stage test, the component's rated voltage is applied to it for a soaking period (typically 100s of ms) and leakage/insulation resistance is again tested. During a typical fifth stage test, the capacitance of the component is again tested to see if it has been affected by the other tests. A first contactor module encountered by the components in the direction of test plate rotation can be used to apply the first stage test to each passing row. The second contactor module encountered can be used to apply the second stage test to each row, and so on. In this way the five tests can be overlapped in time to at least some extent.

It should be understood that this invention can be expanded to more than four seat rings in which case the contactor modules would correspondingly have more than four upperside contacts. Likewise the invention could be implemented with less than three seat rings in which case the contactor modules would correspondingly have less than four upperside contacts. The invention can also be implemented with more or less contactor modules than five. In all cases there would be an equal number of underside contacts in registration with the upperside contacts.

Figure 7:
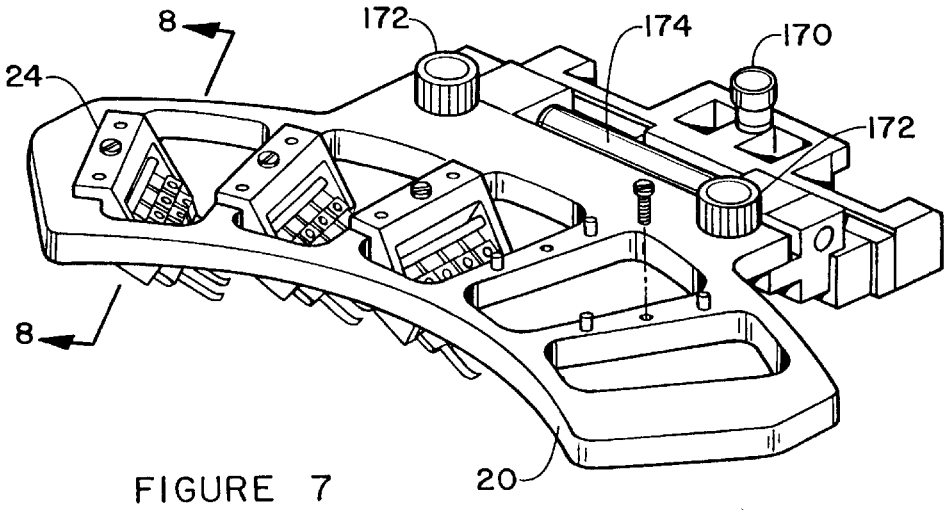
FIG. 7 is a pictorial view of a contactor assembly with less than a full complement of contactor modules mounted thereon.
Figure 8:
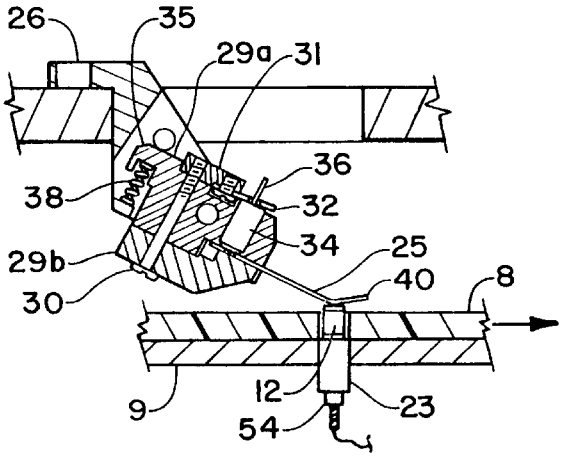
FIG. 8 is a partial cross-sectional view taken along line 8—8 of FIG. 7.
Figure 9:
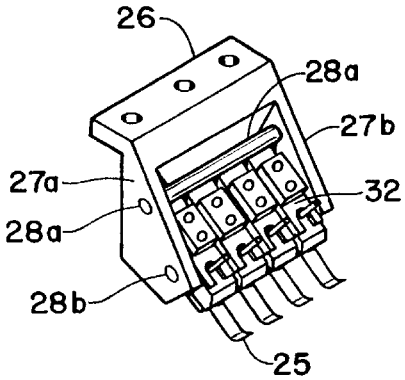
FIG. 9 is a pictorial view of a contactor module.

Referring to FIGS. 7–9, each contactor module 24 includes a mounting bracket 26 with downwardly extending walls, 27A and 27B, at opposite lateral ends of the bracket. Extending between the two walls and supported thereby are two parallel, vertically spaced-apart pins, an upper pin 28A being set back from a lower pin 28B. The lower pin serves as a pivot pin for a plurality of cantilever contact assemblies, and the upper pin serves as a pivot stop. As illustrated, there are four cantilever assemblies side by side, each having an upper body member 29A and a lower body member 29B that are bolted together by a bolt 30 engaged with a clamping plate 31, the plate being at a top of the assembly. Extending forward from the clamping plate is a tongue 32. As illustrated the tongue is connected to the clamping plate by screw means. The free end of the tongue presses down against a top of a linking pin 34 that is disposed in a through-hole defined by the upper body member. Projecting centrally from the top of the linking pin, through a slot defined by the tongue, is a terminal post 36. The bottom end of the linking pin presses against, and electrically contacts, an upperside contact leaf 25 one end of which is clamped between the two body members, and the other end of which projects forward from the cantilever assembly. The terminal post, via the linking pin, provides electrical communication between the upperside contact and the electronics of a tester. Each cantilever assembly is biased against the stop pin 28A by a respective "overtravel" spring 38 acting at one end against a flange projecting from the back of the upper body member 29A, and acting at the other end against a crossbar extending between the mounting bracket walls, 27A and 27B.

The pivoting arrangement and the overtravel spring are to prevent damage to the cantilever assemblies in case an obstruction inadvertently comes into the contact area. Moreover it is convenient to change the overtravel force by changing the spring.

As best illustrated in FIG. 8, the cantilever assemblies are oriented at an angle with respect to the test plate 8, preferably 30°. The upperside contacts 25 are elongated, resilient, flat metal leaves which in operation are made to flex slightly when they encounter seated components. This flexing provides a contact force which can be easily changed by changing the thickness and/or the end width of the leaves. The contact leaves each have an elongated tip 40 that projects away from the test plate at a shallow angle, preferably 5°. The elongated tip is to prevent the components from popping out of their seats as the leaves pass over the back edges (with respect to the direction of test plate travel as indicated by the arrow) of the components. Without the tips, components can pop out due to a "tiddlywink" effect. The angle and length of the tips 40 are so selected that as a component passes out of contact with a leaf 25 and the tip, a portion of the tip is still disposed over the component to block it from popping out of its seat.

Another feature of this invention is that the upperside contact leaves are simple and inexpensive to replace which is advantageous because of normal wear which occurs due to repeated contacting. Moreover the simple cantilever tip can be plated with a variety of materials, particularly precious metal alloys for minimal contact resistance, at low cost.

Optionally the cantilever assemblies can be electromagnetically shielded. For example, small metal boxes can be placed over the top ends of the mounting brackets 26 (FIG. 9), or the brackets can be made out of a non-conductive material that is readily platable (such as G-10 epoxy glass) and selectively plating portions of the brackets, so as not to interfere with the testing circuit, with a shielding material (such as electroless nickel).

Referring to FIGS. 8 and 16–18, each underside contact 23 is illustrated as being a replaceable, elongated cylinder having a central conductive core 42 exposed at both ends of the cylinder, and an electrically insulating outer sleeve 44. The cylinders extend through respective holes 46 defined by the vacuum plate 9 between the vacuum channels 11 such that the cylinders are in registration with uniquely corresponding upperside contacts 25 and are therefore in registration with respective component seat rings. Below the vacuum plate each row of cylinders is held in place by a releasable clamping mechanism that pushes against the sides of the cylinders to pin them against a wall 48. Each cylinder is pressed into a respective cylindrical scallop 50 defined by the wall to keep the cylinders oriented normal to the test plate. So for each row of cylinders there is a clamping mechanism and a pinning wall. Each pinning wall projects from a base 52. Extending through a plurality of slots (not shown) defined by the base, to make electrical contact with the cores of the cylinders, are a corresponding plurality of spring biased pin contacts 54 (e.g. "pogo" pins). There is one base slot per row of cylinders. The pin contacts are mounted in a line in holders 55, four per holder to match a row of cylinders, and each holder is affixed in a respective base slot. The pins 54 are coupled to the tester electronics through wires 56.

Referring again to FIGS. 16–18, also projecting from the base 52 is a wall 58 anchoring the clamping mechanism which includes an elongated, rectangular frame 60 that pivots at one end on pin 62 also projecting from the base. Disposed within the frame is an elongated bar 64 which pivots at its center about a pin 66 extending centrally between long sides of the rectangular frame 60. A face of the bar, the side facing the scallops 50, is planar and has affixed to it a planar elastomer pad 68 which is the part of the clamping mechanism that presses against the cylinders 23. Disposed between the anchor wall 58 and a backside of the bar 64 are a plurality of coil springs 70 disposed to urge the bar against the cylinders. The forces of the coil springs pass through the bar 64 to clamp the cylinders in their respective scallops. Projecting from an end of the frame 60 opposite the pivot pin 62 is a cam rider 72 which abuts the eccentric, i.e. cam, head of a screw 74 journaled in the base. When a low point of the cam faces the cam rider, as in FIG. 17, the bar 64 is free to act against the cylinders. When the screw 74 is turned to bring the high point of the cam against the cam rider, as in FIG. 18, the frame 60 pivots on pin 62 back toward the springs bringing the bar 64 with it to release the cylinders which can then be freely added or removed.

Figure 16:
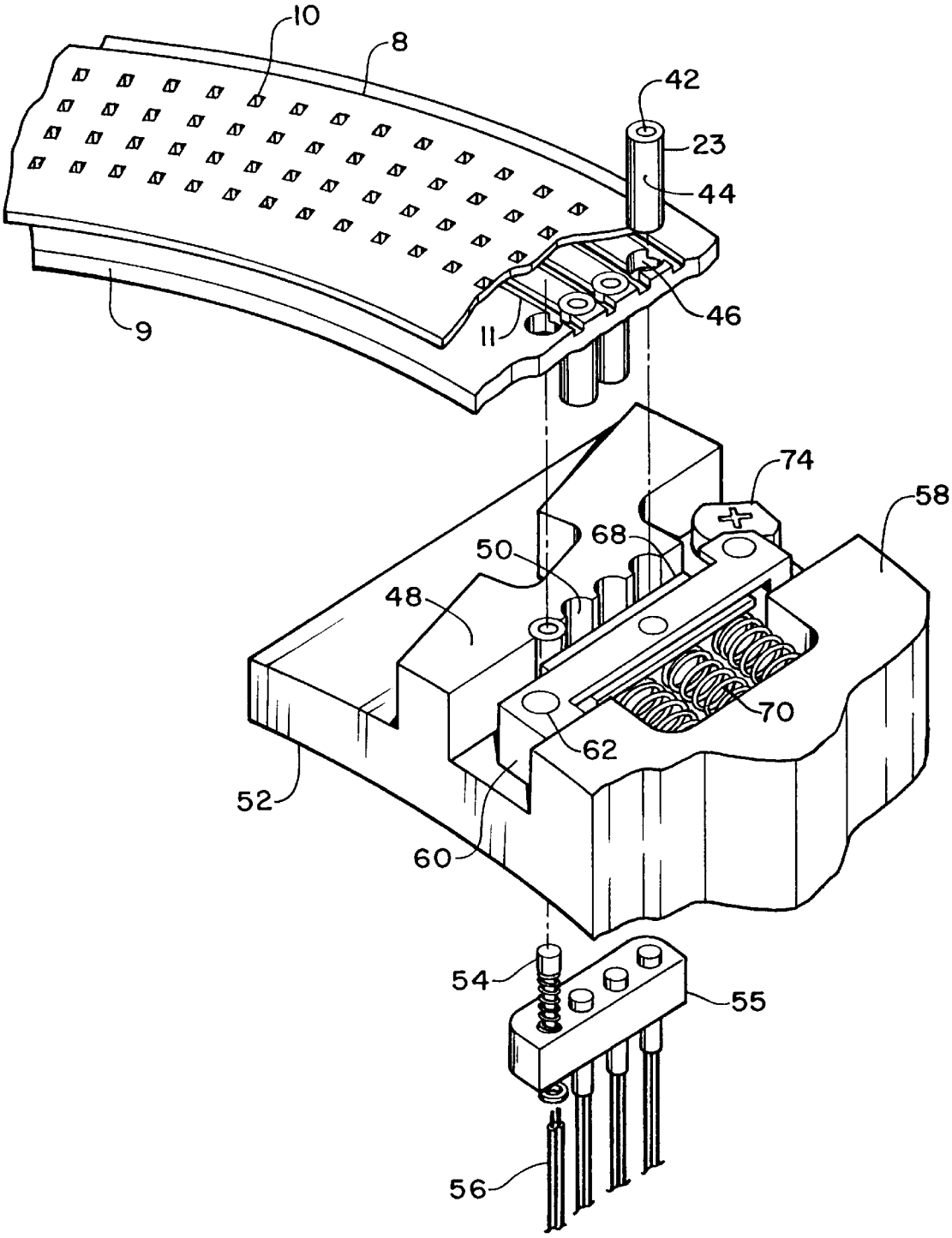
FIG. 16 is an exploded, broken view showing underside (with respect to the test plate) tester contacts.
Figure 17:
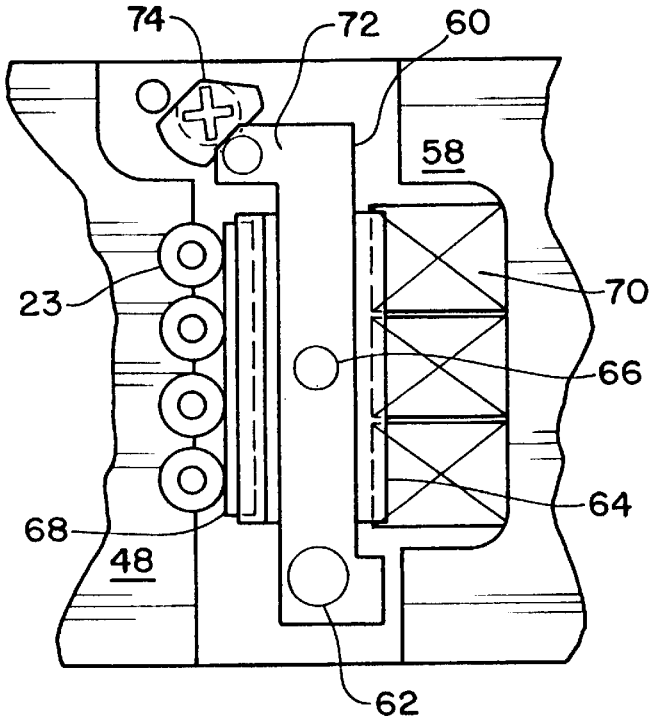
FIGS. 17 and 18 are plan views of a clamp mechanism for retaining underside contact cartridges.
Figure 18:
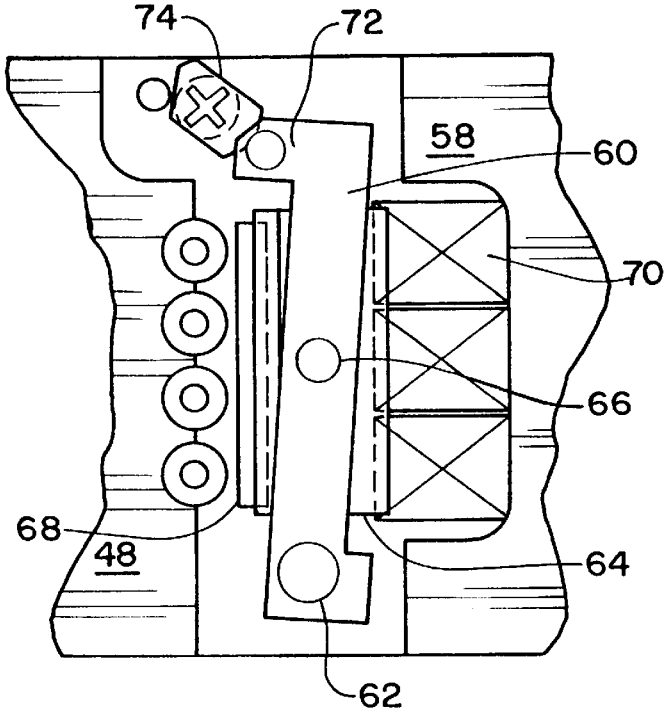

Referring to FIG. 16, installation of the underside contact cylinders 23 first requires retraction of the clamping bar 64 by turning the screw 74 to the position shown in FIG. 18. Then the cylinders are pressed down against respective spring loaded pins 54 until they are flush with the face of the vacuum plate so as not to obstruct movement of the seated components. While held flush the clamping bar is released by turning back the screw 74. By this procedure the underside contacts can be easily installed and replaced as needed.

Figure 3A:
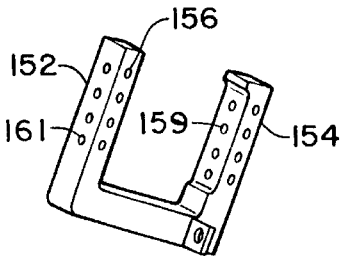
FIG. 3*a* is a pictorial view of a jam sensor bridge according to this invention.
Figure 3B:
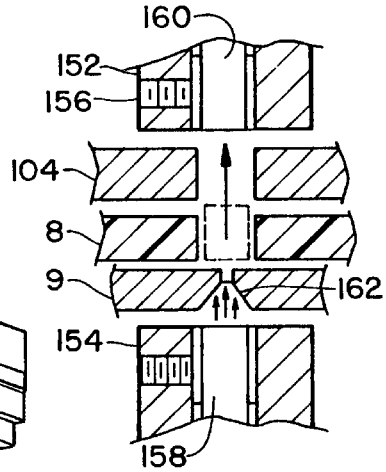
FIG. 3*b* is a diagrammatical cross-section taken laterally across the jam sensor as shown mounted in FIG. 3.
Figure 3:
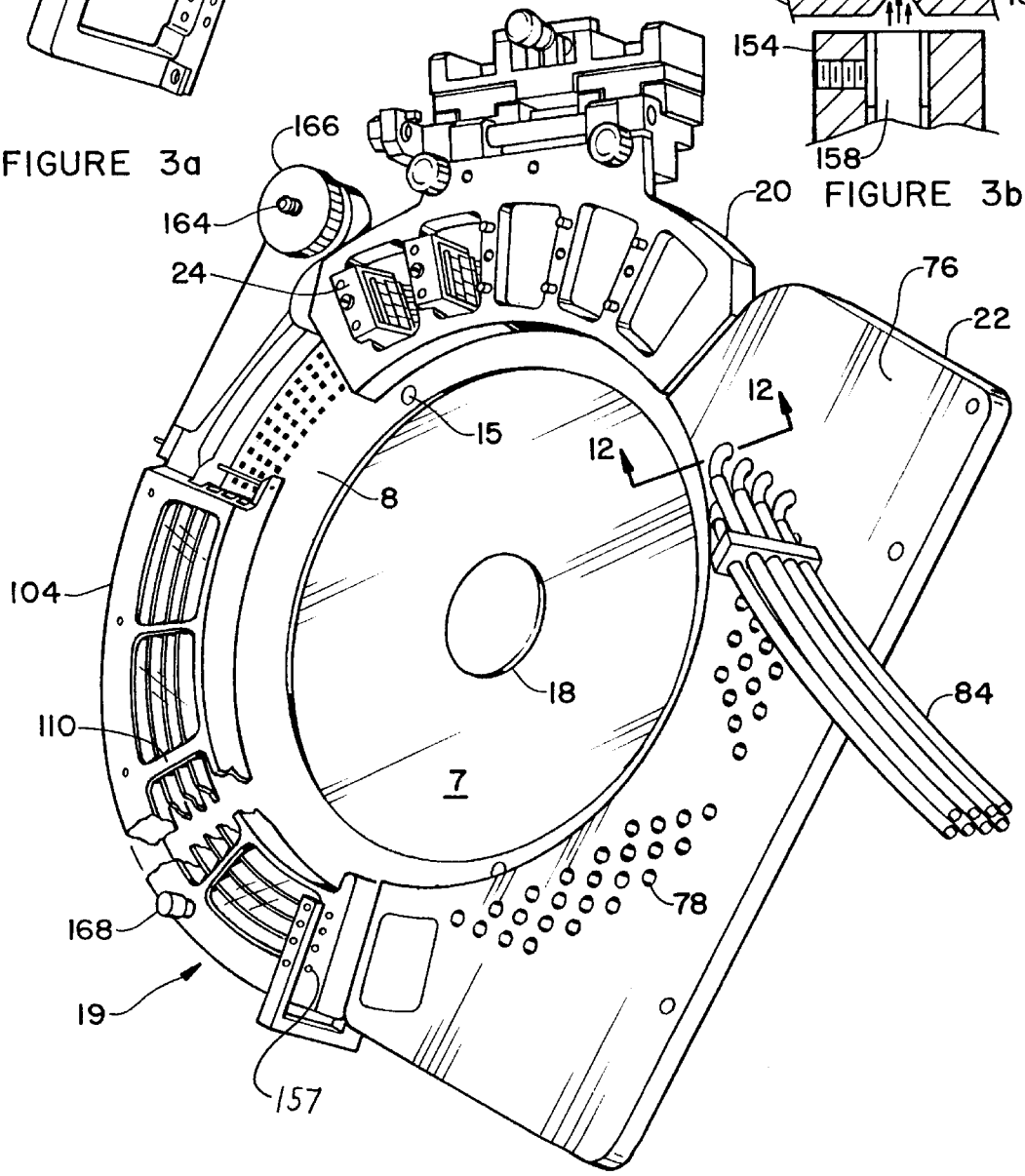
FIG. 3 is an enlarged pictorial view of a turntable, test plate, loading structure, contactor assembly, and ejection manifold according to this invention.
Figure 4:
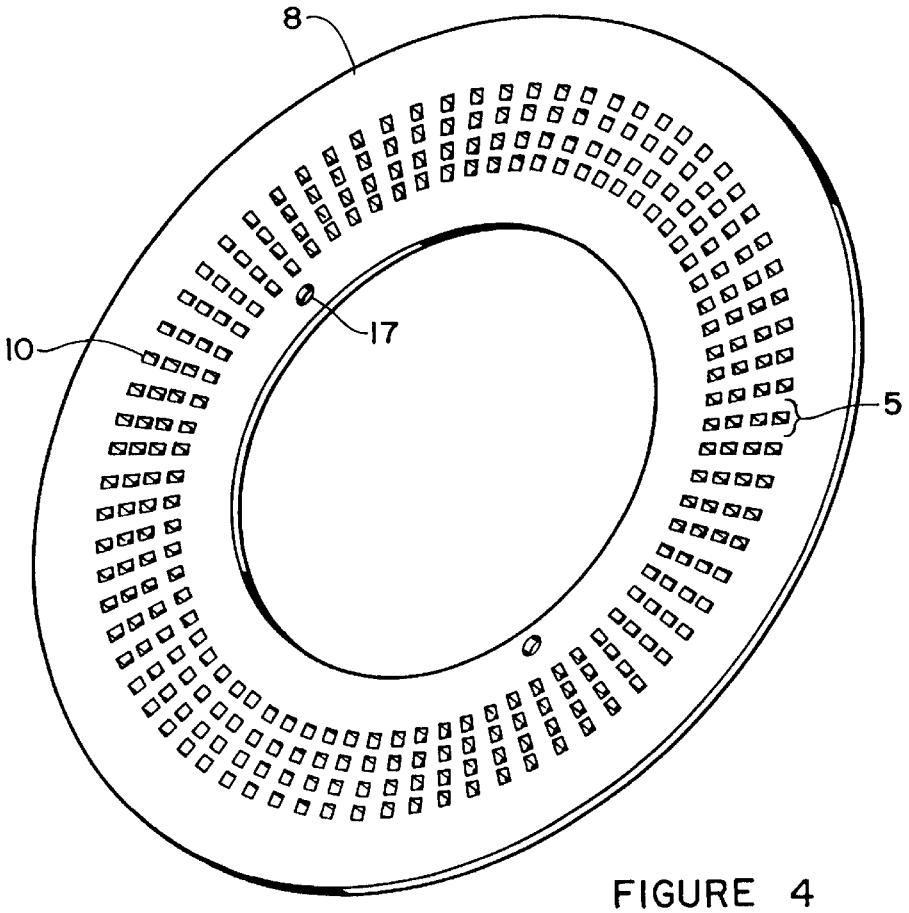
FIG. 4 is a pictorial view of the test plate.
Figure 5:
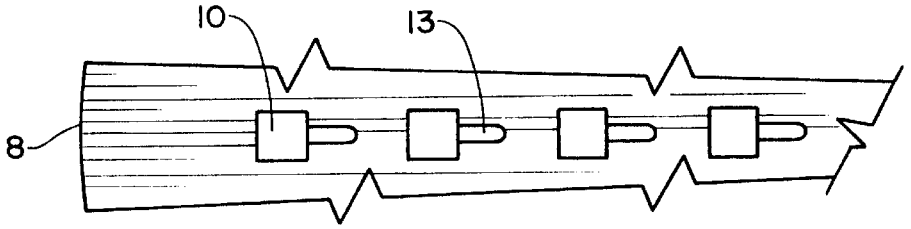
FIG. 5 is a partial view of an underside of the test plate.
Figure 11:
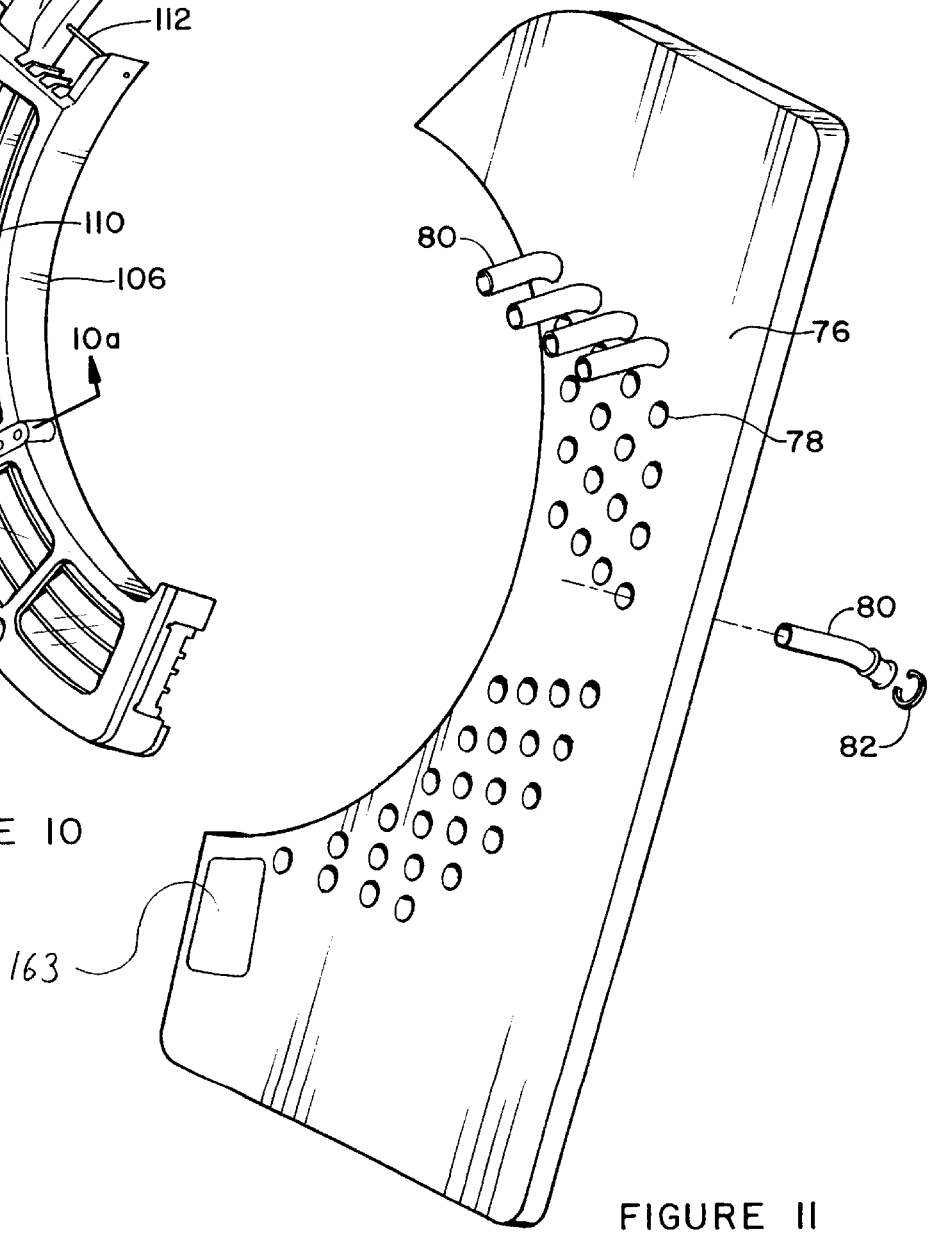
FIG. 11 is an enlarged view of the ejection manifold.

Referring to FIGS. 3 and 11, after being tested, the components are indexed beneath the ejection manifold 22 which, as illustrated, includes a plate 76 defining a plurality of through-holes 78 which register with component seats as the seats are indexed beneath. The holes are sized to accommodate, one each, tube couplers 80 which are slightly bent, rigid tubes which mate with the holes and are secured therein by, for example, snap rings 82. The couplers are sized in inner diameter to freely accommodate the passage therethrough of ejected components. As will be explained in more detail, the components are ejected from their seats by a blast of air from beneath/behind the seats, and the air forces them to pass through the tube couplers into respective ejection tubes 84 connected to the couplers. Although only eight ejection tubes are illustrated, it should be understood that any number, including all, of the holes 78 can have an ejection tube coupled thereto, by means of a coupler 80, for communicating tested components to sorting bins.

Figure 12:
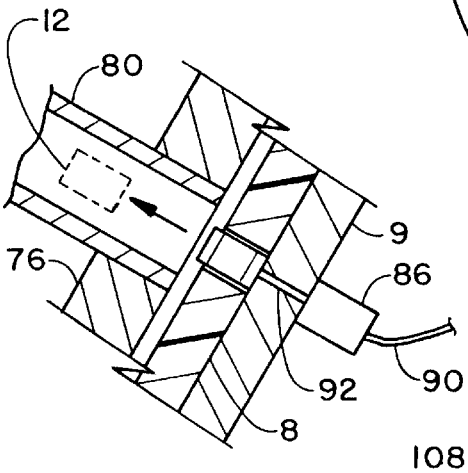
FIG. 12 is a cross-sectional view taken along line 12—12 of FIG. 3.

Referring to FIGS. 3, 11 and 12, beneath/behind the vacuum plate 9 are a plurality of selectively actuated pneumatic valves 86, or tubes from such valves located elsewhere, connected to a source 90 of pressurized air. The valves (or tubes from the valves) are in registration, one each, with the manifold holes 78. Thus each time the test plate is indexed, a set of component seats are brought into registration with, and between, the manifold holes and the pneumatic valves. The vacuum plate 9 defines through-holes 92 also in registration with the pneumatic valves. Thus each component seat in registration with a manifold hole is in an air communication path between the manifold hole and a respective pneumatic valve, and actuation of the valve will cause a component residing in the seat to be forced upward from the seat and through the manifold hole by the air pressure. The air pressure will also drive the component through a respective tube coupler 80 and into the ejection tube 84 connected to the coupler. These bursts of air are of sufficient pressure to overcome the effect of the partial vacuum communicated by the vacuum channels. By this arrangement selected components can be ejected from their seats by selective actuation of the pneumatic valves beneath them. Thus the components in a seat ring can be selectively ejected through any tube aligned with the ring.

Figure 2:
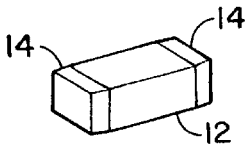
FIG. 2 is an enlarged pictorial view of a typical electrical circuit component for which this invention was conceived.
Figure 1A:
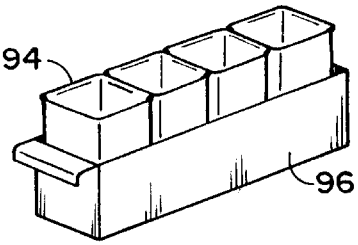
FIG. 1*a* is a pictorial view of a bin shelf containing a plurality of sorting bins.
Figure 1:
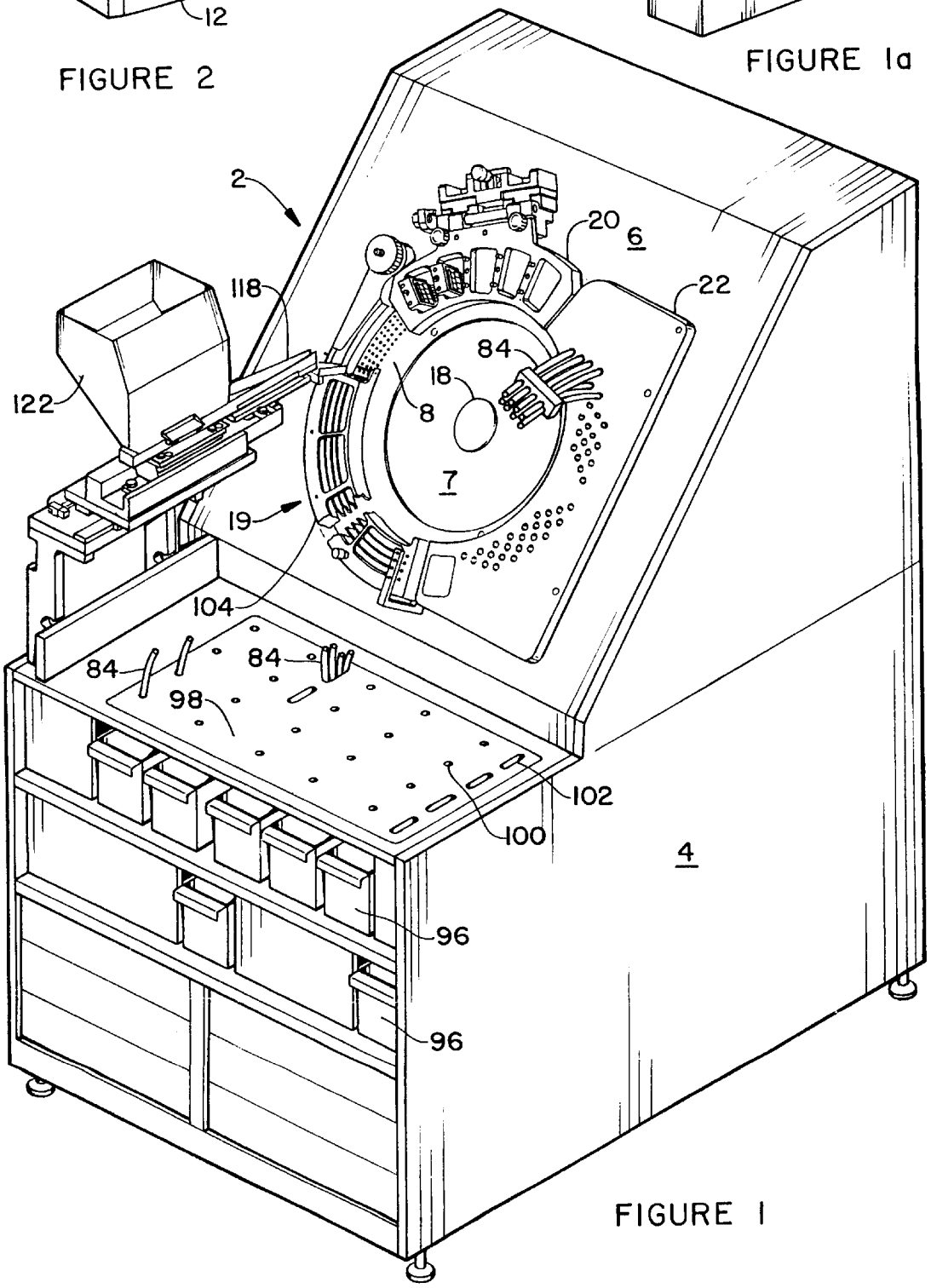
FIG. 1 is an overall pictorial view of the invention in basic structure.

Referring to FIGS. 1 and 1*a*, the ejected components traverse their respective ejection tubes 84, propelled by the bursts of air and gravity, to be deposited in sorting bins 94. As illustrated the bins are carried by bin trays 96, four bins per tray. To collect tested components, the trays of bins are placed on shelves beneath and in front of the ejection manifold 22. The open ends of the tubes (the ends remote from the manifold) are routed to their proper bins by a tube routing plate 98 which defines a plurality of through-holes 100 and through-slots 102. The holes and slots are located to be centrally disposed above their corresponding sorting bins. The holes are sized to accept one ejection tube each, and the slots are sized to accept four tubes each. The open ends of the tubes are inserted into the holes or slots to guide components to their bins below. Although FIG. 1 illustrates, for clarity, only a few broken segments of ejection tubes 84 connected to the ejection manifold and a few broken segments of ejection tubes protruding from the routing plate, it should be understood that all the ejection tubes are actually continuous, i.e. uninterrupted and unbroken, in their runs from the manifold plate to the routing plate and to the corresponding bins below. It should also be understood that all or some portion, as desired, of the manifold ejection holes have tubes running to the routing plate.

Figure 1B:
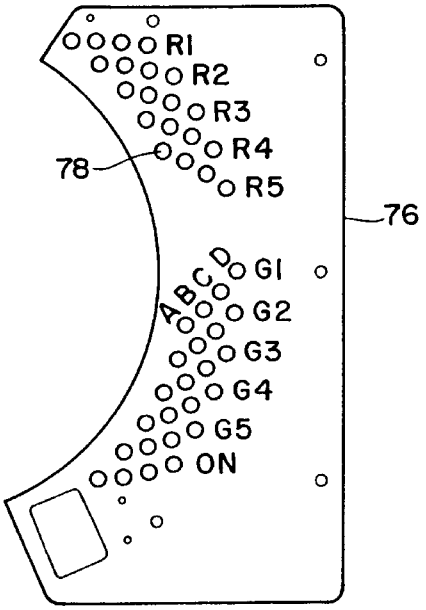
FIG. 1*b* is a plan view of an ejection manifold according to this invention.
Figure 1C:
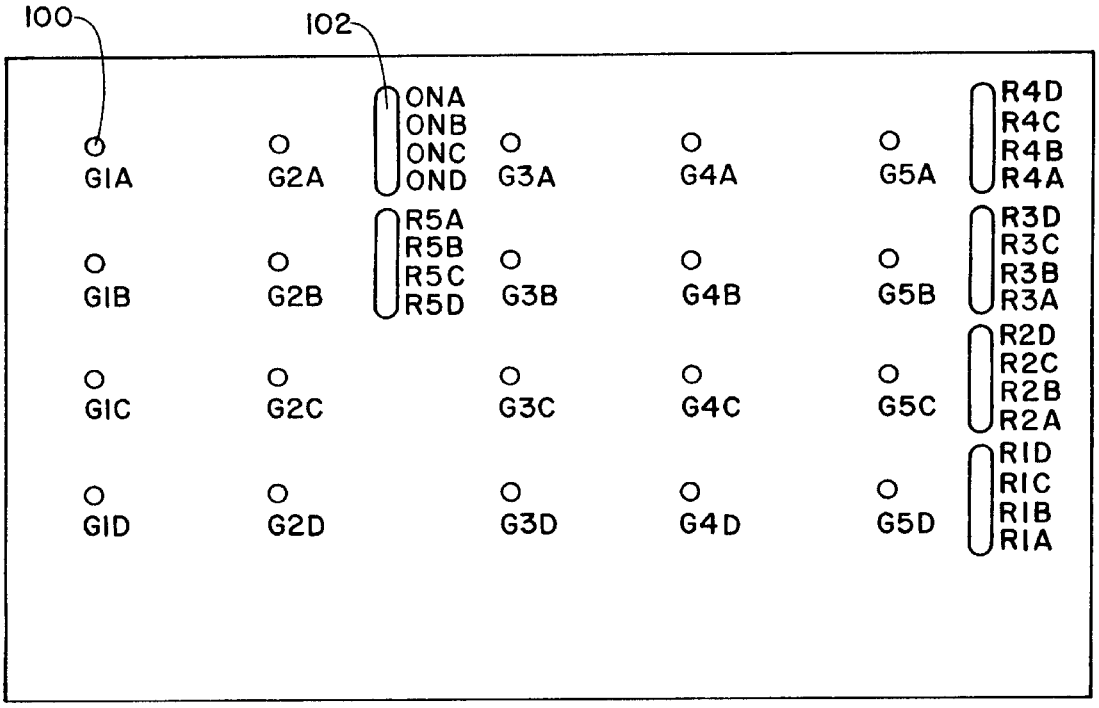
FIG. 1*c* is a plan view of a sorting bin cover according to this invention.

Referring to FIGS. 1, 1*b* and 1*c*, one of many possible ways to coordinate the manifold ejection holes 78 with the tube routing plate 98 is illustrated. In this embodiment there are forty-four manifold holes arranged in eleven rows of four holes each (one for each component seat ring), all coordinately labeled according to row and component seat ring with which they are aligned. There are five rows labeled R1 through R5, five labeled G1 through G5, and one labeled "ON". The four rings are labeled "A" through "D". The rejected parts are ejected through rows R1–R5 to traverse corresponding tubes 84 destined for routing plate rejection slots with appropriate bins below. In this embodiment, the holes of manifold row R1 communicate, via respective ejection tubes, with the routing plate slot labeled R1A–R1D. Row R2 communicates with the slot labeled R2A–R2D, and so on through row R5. The good parts are ejected through rows G1–G5, e.g. according to their testing results, to traverse corresponding tubes destined for routing plate "good" holes with appropriate bins below. The manifold holes having coordinates G1,A through G1,D communicate, via respective ejection tubes, with routing plate holes G1A through G1D, respectively. The manifold holes having coordinates G2,A through G2,D communicate with routing plate holes G2A through G2D, respectively, and so on through row G5. The manifold holes in row ON communicate with the routing plate slot labeled ONA-OND. The parts ejected via the ON row are those components that, for one reason or another, were not ejected through any of the preceding manifold holes. The pneumatic valves behind the ON row are always actuated to eject any components reaching the ON row.

Referring to FIGS. 1, 3, 10, 10*a* and 14, the components 12 are distributed into the test plate seats in the loading area 19 which lies beneath a stationary, arcuate loading frame 104. The loading frame has a containment wall 106 and a plurality of seating fences, illustrated as four walls, 108*a*–108*d*, matching in number the four component seat rings. The seating fences are of uniform height and are connected remote from the test plate by cross members 110. The arcs of the seating fences are concentric with the seat rings and there is one seating fence immediately adjacent the outboard side of each seat ring. The bases of the seating fences are slightly spaced above the test plate, for example by shims, so as to prevent passing or catching of components beneath the fences. Preferably the fences extend from about the nine o'clock position of the test plate (using the hour points of a clock as position indicators) to about the five o'clock position. At the nine o'clock end of the loading frame, the gaps between the fences, 110*a*–110*d*, are open to serve as mouths for insertion of components in the gaps. In operation, components to be tested are poured into the gaps in generally equal proportions, and as the components fall downward they are distributed and tumble along the seating fences by gravity. Distribution can be further assisted by use of an air knife 112 having a plurality of forced air nozzles, one directed into each gap between the fences. As illustrated, the test plate turns in the clockwise direction and due to gravity each unseated component continuously tumbles in the opposite direction, along a seating fence, over empty seats passing through an arc of the ring's rotation path until it is eventually seated. Once in the seats, they are held therein by partial vacuum communicated to the seats from the annular vacuum channels 11 (FIG. 6).

Figure 14:
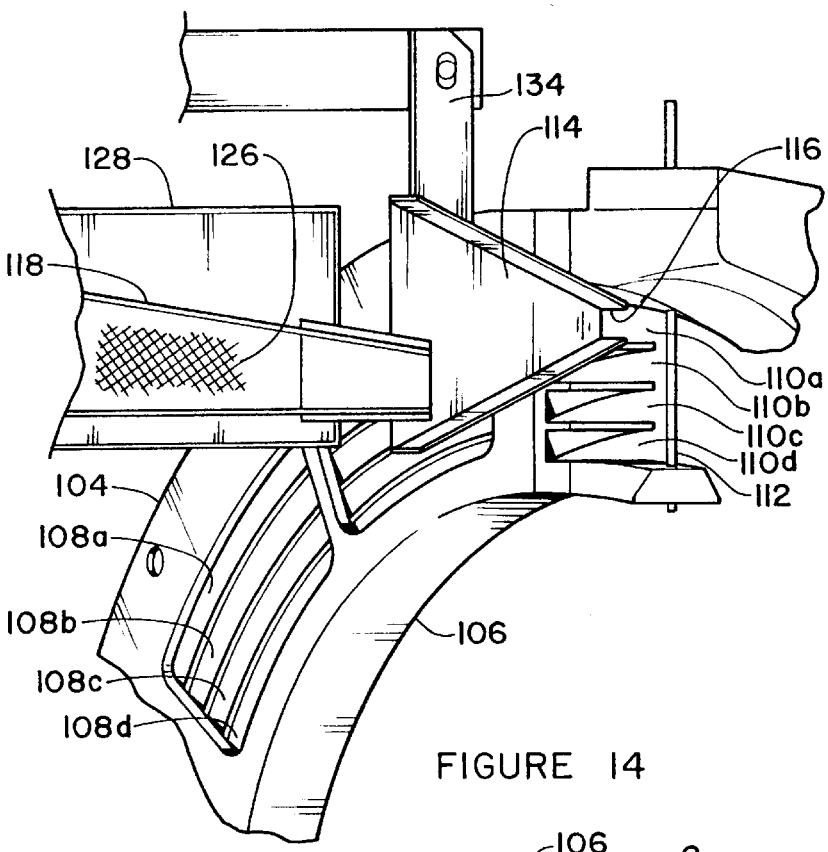
FIG. 14 is a partial plan view of a spout of the hopper assembly.
Figure 13:
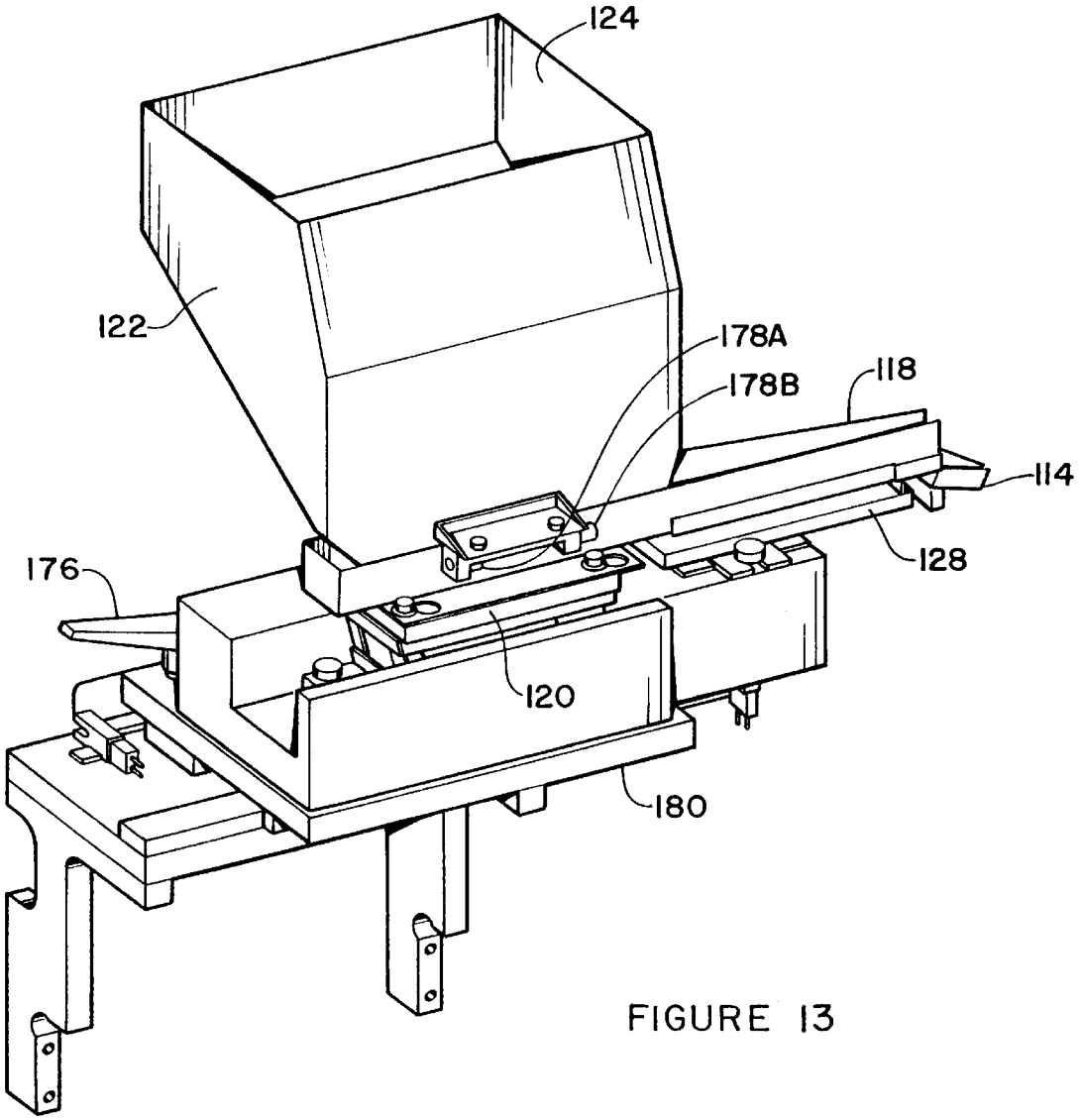
FIG. 13 is a pictorial view of a component hopper assembly.
Figure 15:
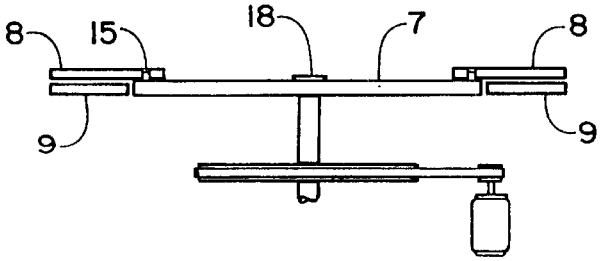
FIG. 15 is a cross-sectional view of the turntable, the test plate, and the vacuum plate taken along a diameter of the turntable between opposite test plate locator pins.

Referring to FIGS. 1, 13 and 14, the components to be tested are poured into the gaps, 110*a*–110*d*, between the seating fences by an open top funnel 114 having a mouth 116 the width of which matches the gaps between the fences. As will be explained below, the funnel can be selectively positioned squarely over each of the four gaps so as to pour components primarily into the selected gap. The funnel receives a stream of components from a stationary feeder tray 118 which is mounted on a shaker 120. The feeder tray preferably is gravity fed quantities of components from a hopper 122 and the shaker vibrates the feeder tray to move the components to the funnel. The hopper has a large input mouth 124 which funnels the components to the tray. The spacing of the output mouth (not shown) of the hopper above the tray effectively meters the components to the tray. A portion 126 of the floor of the feeder tray is perforated by uniformly sized holes, and below the perforated portion is a catch tray 128. The perforations are to filter out undersized components which will pass through the perforations and be caught by the catch tray below. The perforated portion is preferably a mesh.

Figure 10:
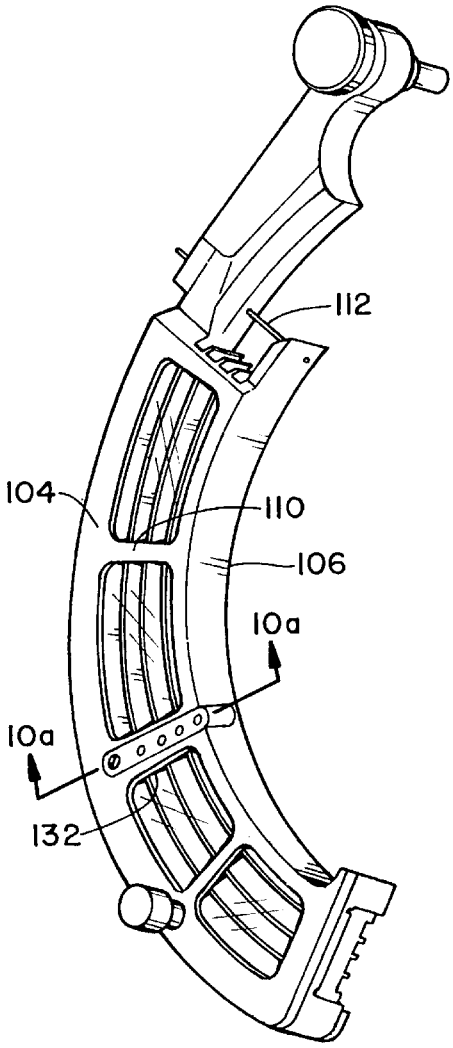
FIG. 10 is an enlarged pictorial view of the loading structure.
Figure 10A:
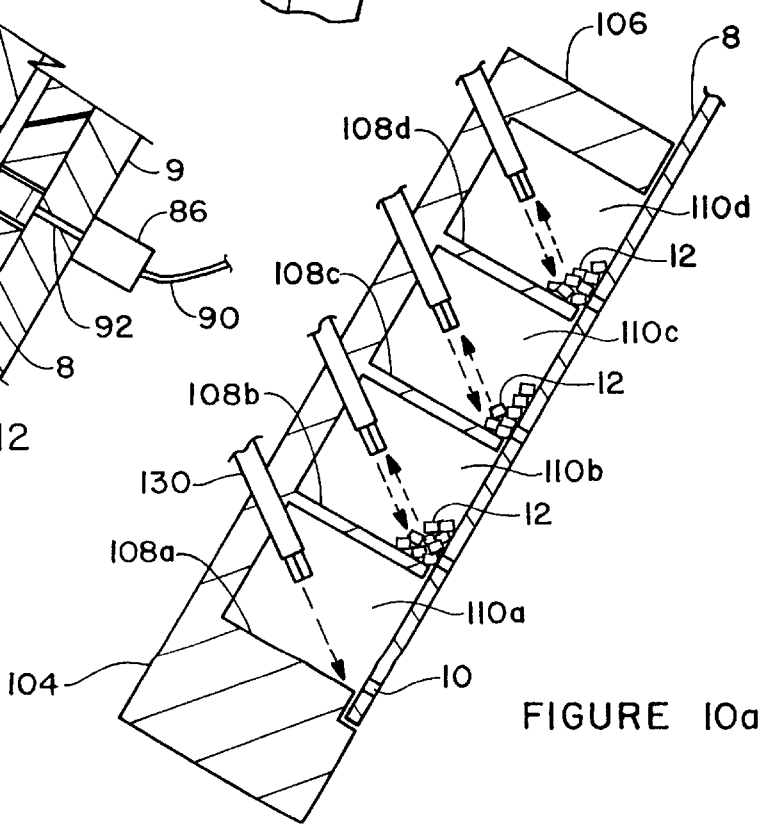
FIG. 10*a* is a cross-sectional view taken along line 10*a*—10*a* of FIG. 10.

Referring to FIGS. 10, 10*a* and 14, the position of the funnel 114 over the gaps, 110*a*–110*d*, is controlled by a processor (not shown) that determines which gap or gaps are in most need of components. The processor receives signals from a plurality of component sensors 130, one per gap, disposed in respective angular holes defined by a loading frame cross member 132. The sensors each include a pair of fiber optic cables, one cable coupled to a coherent light source, such as a laser beam generator, and the other cable coupled to a photodetector. The holes are angled such that the free ends of the optic cables are aimed at the downhill corners of the gaps, i.e., the corners in which the components should collect due to gravity, as best illustrated in FIG. 10*a*. The components are typically light reflective. The dashed arrows of FIG. 10*a* pointing to the downhill corners represent light beams being emitted by the sensors, and the dashed arrows in reverse represent those portions of the reflected light that impinge the sensors.

In operation each sensor 130 directs a light beam toward the downhill corner of its gap, and if there are no components present in the corner (as in gap 110*a* of FIG. 10*a*), then the beam will not be reflected or be reflected to a much lesser degree than if components were present (as in gaps 110*b*–110*d* of FIG. 10*a*). The lack of, or lesser, reflection is noted by the processor. If this condition persists over a predetermined period of time, the processor will then actuate a motor (not shown) which drives an arm 134 to position the mouth of the funnel over the gap in need of components. When the handler is operating, this process of checking the gaps and moving the funnel is continuous. In this manner components are distributed to the gaps in generally equal proportions. It has been found that by locating the sensors at about the seven o'clock position, with respect to the test plate, they are in an optimum position for sensing the absence of components.

Figure 19:
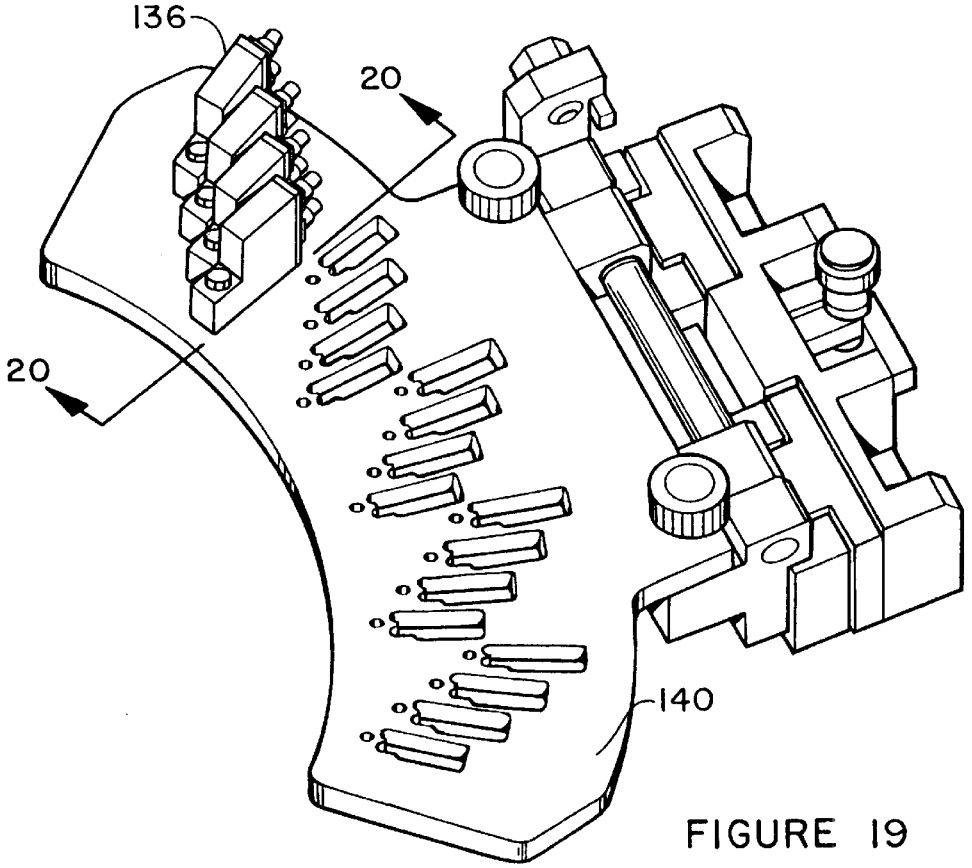
FIG. 19 is a pictorial view of an alternative contactor assembly with less than a full complement of contactor modules mounted thereon.
Figure 20:
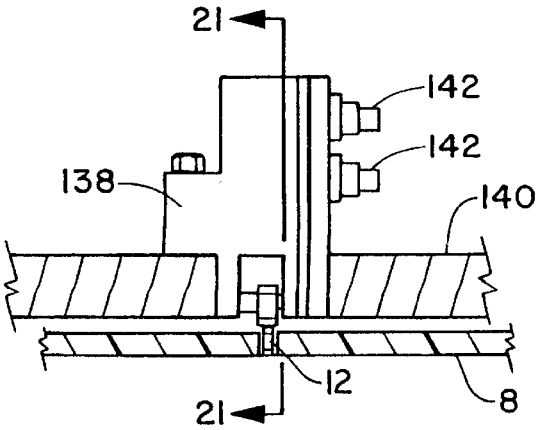
FIG. 20 is a partial cross-sectional view taken along line 20—20 of FIG. 19.
Figure 21:
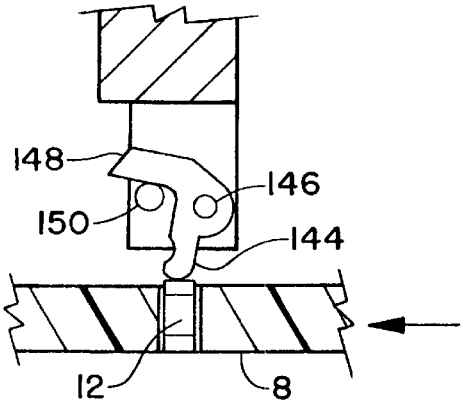
FIG. 21 is a partial cross-sectional view taken along line 21—21 of FIG. 20.

Referring to FIGS. 19–21, an alternative contactor assembly is illustrated to include five groups of four upperside contactor modules 136 each. Each module includes a housing 138 and is mounted on a top face of a support plate 140 and communicates with a tester, such as a computer, via plug-in type coupling terminals 142. Each contactor module also includes a contact mechanism, operably connected to the housing, for making electrical contact with the components that pass beneath it. As illustrated, each housing includes a base portion extending through a hole defined by the support plate, and the contact mechanism is a contact arm 144 connected to a shank that rotates about a pivot pin 146 connected to the base portion. The free end of the arm is rounded to avoid wear on the components. Also connected to the shank in angular relation to the contact arm is a stop arm 148 for encountering a stop pin 150. Not shown is a spring which biases the stop arm against the stop pin. Since the turntable is indexed, i.e. turned in incremental steps, the contact arms preferably begin wiping against the upright terminals 14 of the components 12 in the last one or two degrees of a step in order to make better contact. The arrow of FIG. 21 shows the direction of test plate rotation for purposes of these illustrations. Beneath the test plate and in registration with the components seats are a plurality of underside contactors which can be as described above, or nail-type. In this way, both terminals of each component are contacted simultaneously by a wiping arm 144 and an underside contactor, both of which are in communication with a test circuit.

Referring to FIGS. 3, 3*a* and 3*b*, a jam sensor bridge is shown to be U-shaped and mounted so as to straddle the vacuum plate 9, the test plate 8, and the loading frame 104. The legs, 152 and 154, of the bridge each define four through-holes, 161 and 159 respectively, the holes of one leg being in registration with the holes of the other leg. When so mounted the holes of the legs are also in registration with the four component seats of each seat row as they are indexed between the bridge legs. Also in registration with the bridge legs' holes are four through-holes 157 defined by the loading frame and four conical through-holes 162 defined by the vacuum plate. Disposed one each in the holes of the bridge leg 154 that is behind/beneath the vacuum plate are four light emitting cables 158 directing light toward the conical through-holes, and disposed one each in the holes of the other bridge leg 152 are four fiber optic cables 160, coupled to photodetectors (not shown), whose light admitting ends face the holes defined by the loading frame. The conical holes are for focusing the emitted light to the center of each registered seat so that if a component is in the seat, the component will block the emitted light. Without a component in the seat, the emitted light will reach the corresponding photodetector. So any components that are still in their seats after passing by the ejection manifold can be detected due to the fact that they will each interrupt a jam sensor light beam.

Referring to FIG. 11, the ejection manifold also defines a through-hole 163 for mounting a conventional deionizer to prevent the build-up of static electricity in the test plate.

Referring to FIG. 3, the loading frame 104 can be rotated on a pivot pin 164 away from the test plate 8 and can be locked into place by a thumb screw 166 and locking pin 168. This facilitates installation and replacement of test plates.

Referring to FIGS. 7 and 8, the contactor assembly 20 includes a pivot pin 174 to allow the assembly to be rotated up and away from the test plate to also facilitate installation and replacement of test plates which are necessarily changed when the size and/or form of the components to be tested are changed. This also facilitates installation and replacement of upperside contact leaves 25 which will of course wear out due to repeated rubbing engagement with components. Thumb screws 172 are used to lock the assembly from pivoting inadvertently. The height of the assembly above the test plate can be accurately and conveniently adjusted by a micrometer leveler 170 which moves the entire assembly up or down along two guides (not shown).

Referring to FIG. 13, the hopper 122, feed tray 118 and funnel 114 can all be slid back along guides to also facilitate installation and replacement of test plates. They and the shaker 120 are all mounted on a slidable plate 180 which slides on bearing guides below. The plate is locked in place for operation by a lever 176 connected to a locking mechanism (not shown). Also, the hopper can be dumped by releasing a lock (not shown) and pushing it forward to engage a bracket affixed to a hopper wall with two pivot pins, 178A and 178B affixed to the feeder tray 118 wall. Once the pins are engaged the hopper can be rotated on them to spill the contents of the hopper.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

We claim:

1. A component handler comprising:

(a) a ring of component seats comprising cylindrical holes defined in a plate having a center, the holes being normal to the plane of the plate, the ring being concentric with the plate's center, (b) means for rotating the ring by rotating the plate about its center, (c) means, in the path of the rotating ring, for receiving a stream of components and seating them in the ring, (d) means, in the path of the rotating ring, for electrically contacting each seated component sufficiently for testing of same, (e) a plurality of bins, and (f) means, in the path of the rotating ring, for ejecting each tested component from its seat and directing it into a selected one of the plurality of bins.

2. The handler according to claim 1 further comprising partial vacuum means for holding the components in their seats.

3. The handler according to claim 1 further comprising means for detecting components that were not ejected by the means for ejecting.

4. The handler according to claim 1 wherein the plate is inclined at an angle form vertical and the stream of components is poured onto the ring as it is rotating, and wherein the means for receiving and seating components comprises means for confining poured and unseated components comprises means for confining poured and unseated components to tumble randomly, due to gravity, over empty seats passing through an arc of the ring's rotation path, the random tumbling over the passing seats resulting in the seating of the components.

5. The handler according to claim 4 wherein the means for confining comprises a stationary, arcuate fence concentric with the ring, and disposed along and adjacent to an outboard side of the seats of the ring.

6. The handler according to claim 5 wherein the fence extends counterclockwise from substantially the nine o'clock position, relative to the ring, to substantially the five o'clock position.

7. The handler according to claim 2 wherein the the partial vacuum means comprises:

(a) a partial vacuum source, (b) a vacuum channel defined by a stationary plate and coupled to the partial vacuum source, the vacuum channel being concentric with and adjacent to the seat ring, and (c) a plurality of linking channels, one per seat, defined by the rotatable plate, the linking channels communicating the partial vacuum from the vacuum channel to their respective seats.

8. The component handler according to claim 1 wherein the seats of the ring are uniformly angularly spaced, and the ring is incrementally rotated, the increment being the angular space between adjacent seats.

9. The handler according to claim 8 wherein each seat only accepts a component when the component's terminal axis is aligned, within a tolerance, with the seat; wherein each seat exposes both upperside and underside terminals of the components; and wherein the means for electrically contacting the components comprises:

(a) a plurality of upperside contacts aligned with the ring for contacting the components from above, and (b) a corresponding plurality of underside contacts for contacting the components from below, each upperside contact being in registration with one underside contact and in registration with a seat each time the ring is rotated an increment.

10. The handler according to claim 9 wherein the upperside contacts comprise cantilevered, resilient leaves which wipe across the upper terminals of the components at an angle.

11. The handler according to claim 10 wherein the cantilevered leaves each further comprise an elongated tip angled away from the components, the angle and length of the tip being selected to prevent components from popping out of their seats due to tiddlywink effect.

12. The handler according to claim 8 wherein the means for ejecting and directing the components comprises:

(a) an ejection manifold defining a plurality of ejection holes each of which registers with a component seat each time the ring is rotated an increment, (b) a corresponding plurality of tubes coupled to the ejection holes, the tubes directing ejected components therein to the bins, and (c) a corresponding plurality of selectively actuated pneumatic means for applying air pressure into seats in registration with the ejection holes in order to eject components in the seats into respective tubes.

13. A component handler comprising:

(a) a plurality of concentric rings of component seats, (b) means for rotating the rings around their center, (c) means, in the paths of the rotating rings, for receiving a stream of components and seating them in the rings, (d) means, in the paths of the rotating rings, for electrically contacting each seated component sufficiently for testing of same, (e) a plurality of bins, and (f) means, in the paths of the rotating rings, for ejecting each tested component from its seat and directing it into a selected one of the plurality of bins.

14. The handler according to claim 13 further comprising partial vacuum means for holding the components in their seats.

15. The handler according to claim 13 further comprising means for detecting components that were not ejected by the means for ejecting.

16. The handler according to claim 13 wherein the rings are inclined at an angle from vertical and the stream of components is poured onto the rings as they are rotating, and wherein the means for receiving and seating components comprises means for confining unseated components to tumble randomly, due to gravity, over empty seats passing through arcs of the rings' rotation paths, the random tumbling over the passing seats resulting in seating of the components.

17. The handler according to claim 16 wherein the means for confining comprises a plurality of stationary, arcuate fences uniquely corresponding to and concentric with the rings, each fence being disposed along and adjacent to an outboard side of the seats of its corresponding ring.

18. The handler according to claim 17 wherein the fences extend counterclockwise from substantially the nine o'clock position, relative to the rings, to substantially the five o'clock position.

19. The handler according to claim 13 further comprising means for selectively directing the stream of components to each ring for seating.

20. The handler according to claim 17 further comprising means for selectively directing the stream of components to each fence.

21. The handler according to claim 20 further comprising:

(a) means for detecting the absence of components along a fence and producing a corresponding signal, and (b) handler processing means, responsive to the signal, for directing the stream of components to said fence.

* * * * *

UNITED STATES PATENT AND TRADEMARK OFFICE

CERTIFICATE OF CORRECTION

PATENT NO. : 5,842,579
DATED : December 1, 1998
INVENTOR(S) : Garcia, et al

It is certified that error appears in the above-identified patent and that said Letters Patent is hereby corrected as shown below:

Column 10, line 22, "components" should read - - component --.

Column 11, line 51, "form" should read - - from--.

Column 11, lines 54-55, immediately after the word "components" delete the words "comprises means for confining poured and unseated components"

Signed and Sealed this

Twenty-third Day of March, 1999

*Attest:*

Q. TODD DICKINSON

*Attesting Officer*

*Acting Commissioner of Patents and Trademarks*